US007292795B2

(12) United States Patent
Kuroki et al.

(10) Patent No.: US 7,292,795 B2
(45) Date of Patent: Nov. 6, 2007

(54) IMAGE FORMING APPARATUS WITH CARBON BASED FIXING MATERIAL

(75) Inventors: Kenji Kuroki, Toride (JP); Katsuhide Koga, Moriya (JP); Jun Nakazato, Toride (JP); Tomoichiro Ohta, Kashiwa (JP); Yoshitaka Yamazaki, Toride (JP); Nobuo Sekiguchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 11/186,960

(22) Filed: Jul. 22, 2005

(65) Prior Publication Data

US 2006/0024072 A1 Feb. 2, 2006

(30) Foreign Application Priority Data

Jul. 27, 2004 (JP) ..... 2004-218390

(51) Int. Cl.
*G03G 15/20* (2006.01)

(52) U.S. Cl. ..... 399/33

(58) Field of Classification Search ..... 399/9, 399/24, 33
See application file for complete search history.

(56) References Cited

U.S. PATENT DOCUMENTS

| | | | | |
|---|---|---|---|---|
| 5,942,882 | A | 8/1999 | Ohta | 323/282 |
| 6,016,409 | A * | 1/2000 | Beard et al. | 399/33 |
| 6,104,889 | A * | 8/2000 | Saitoh | 399/33 |
| 6,115,510 | A | 9/2000 | Koga | 382/309 |
| 6,188,054 | B1 | 2/2001 | Ohta | 219/663 |
| 6,308,947 | B1 | 10/2001 | Kojima et al. | 271/124 |
| 6,393,232 | B1 | 5/2002 | Osari et al. | 399/82 |
| 6,483,995 | B2 * | 11/2002 | Iwaki et al. | 399/33 |
| 6,502,816 | B2 | 1/2003 | Inoue et al. | 271/121 |
| 6,526,251 | B1 | 2/2003 | Otsuka et al. | 399/313 |
| 6,691,399 | B1 | 2/2004 | Hayashi et al. | 29/605 |
| 6,785,506 | B2 | 8/2004 | Kato et al. | 399/333 |
| 6,933,480 | B2 | 8/2005 | Ohta | 219/635 |
| 6,944,408 | B2 * | 9/2005 | Holzner | 399/24 |
| 6,959,158 | B2 | 10/2005 | Ohta | 399/69 |
| 6,987,251 | B2 | 1/2006 | Fukushi et al. | 219/619 |
| 7,030,345 | B2 | 4/2006 | Nishihara et al. | 219/619 |
| 7,039,336 | B2 | 5/2006 | Ohta | 399/69 |
| 7,053,345 | B2 | 5/2006 | Fukushi et al. | 219/619 |
| 7,106,987 | B2 | 9/2006 | Ohta | 399/69 |
| 2003/0002895 | A1 | 1/2003 | Kato et al. | 399/333 |
| 2005/0220466 | A1 | 10/2005 | Takahashi et al. | 399/45 |
| 2005/0220467 | A1 | 10/2005 | Takahashi et al. | 399/45 |
| 2005/0249511 | A1 | 11/2005 | Sekiguchi et al. | 399/20 |

(Continued)

FOREIGN PATENT DOCUMENTS

| | | |
|---|---|---|
| JP | 3-200187 | 9/1991 |

(Continued)

*Primary Examiner*—William J. Royer
(74) *Attorney, Agent, or Firm*—Fitzpatrick, Cella, Harper & Scinto

(57) ABSTRACT

An image forming apparatus has a fixing unit for fixing a toner image formed on a recording material, and a heater, for heating the fixing unit, made of a carbon-based material. In order to detect and expect the life of the heating unit with good accuracy, the image forming apparatus further has a current measuring device for measuring a current passing through the heating unit and a notification device for providing notification of information on a life of the heating unit depending on an output of the current measuring device.

4 Claims, 7 Drawing Sheets

U.S. PATENT DOCUMENTS

| | | | | |
|---|---|---|---|---|
| 2006/0018678 | A1 | 1/2006 | Sekiguchi et al. | 399/70 |
| 2006/0024072 | A1 | 2/2006 | Kuroki et al. | 399/33 |
| 2006/0083528 | A1 | 4/2006 | Mori et al. | 399/67 |
| 2006/0131301 | A1 | 6/2006 | Ohta et al. | 219/619 |
| 2006/0157475 | A1 | 7/2006 | Nishihara et al. | 219/619 |

FOREIGN PATENT DOCUMENTS

| | | |
|---|---|---|
| JP | 2003-107948 | 4/2003 |
| JP | 2003-202769 | 7/2003 |
| JP | 2003-215963 | 7/2003 |

* cited by examiner 801 802 803

| | | | | |
|---|---|---|---|---|
| MEASURING TIME | 11/24 22:00 | 11/25 22:00 | 11/26 22:00 | 11/27 22:00 |
| MEASURED RESISTANCE | 12.50000 | 12.50000 | 12.50423 | 13.00857 |

$R_{26}$ $R_{27}$

IMAGE FORMING APPARATUS WITH CARBON BASED FIXING MATERIAL

FIELD OF THE INVENTION AND RELATED ART

The present invention relates to an image forming apparatus using electrophotography or electrostatic recording, particularly an image forming apparatus, such as a copying machine, a printer, FAX (facsimile) machine, or the like.

An image forming apparatus, for performing heat fixation of an image with respect to a sheet, such as a copying machine or printer of an electrophotographic type is constituted by respective units of developing apparatus, a latent image apparatus, a transfer apparatus, a fixing apparatus, and the like. Respective parts of these units have a different life (span) for each part. For this reason, in order to provide a user with always stable image output, it is necessary to appropriately set the life so as to effect indication of life warning or estimation of remaining time to the user and display which urges the user to replace the part.

Of the above described units of the image forming apparatus, the fixing apparatus for fixing an unfixed toner image includes a heater part for heating a fixation roller. The heater has the life, so that, as a method for detecting the life, detection of the life of the heater has been made by counting an energization time of the heater by means of a microcontroller or judgement that the heater reaches the end of its life in the case where the heater is not increased in temperature to a predetermined temperature in a certain time has been made. Further, as a specialized example for the image forming apparatus, as described in Japanese Laid-Open Patent Application No. Tokkaihei 03-200187 and conventional examples, such a method that the end of life is judged by reaching of the number of count of sheets passing through a fixing apparatus to a certain value or by a difference in temperature between a central portion and an axial end portion of a fixation roller by means of sensors disposed at the portions has been employed.

However, according to the conventional methods, there have arisen such problems that the end of life is detected although the heater does not actually reach its end of life and thus replacement of the heater is required, that it is on the basis of an actual temperature of the fixation roller but the temperature is not accurately measured due to an ambient temperature environment, another heating means, and the kind and size of sheet used, and that the end of life is suddenly detected depending on a temperature rise state of the fixation roller.

Further, in recent years, there is growing environmental awareness, so that reuse of a product itself or a part unit is improved. In this case, according to the conventional detection means, an actual life and count information on an operation time by a microcontroller are not necessarily in agreement with each other in some cases. For this reason, particularly in the case where a heater has a longer life than a main assembly, when the heater is reused, there has arisen a problem that a detection accuracy of the life is remarkably impaired.

SUMMARY OF THE INVENTION

The present invention has been accomplished in view of the above described problems of the conventional apparatus.

An object of the present invention is to provide an image forming apparatus capable of performing detection and estimate of end of life of a heater with good accuracy.

According to the present invention, there is provided an image forming apparatus, comprising:

fixing means for fixing a toner image formed on a recording material, heating means, for heating the fixing means, comprising a carbon-based material, current measuring means for measuring a current passing through the heating means, and notification means for providing notification of information on a life of the heating means depending on an output of the current measuring means.

By the image forming apparatus according to the present invention, it is possible to detect the end of life of the heating means with good accuracy. Accordingly, it is possible to reduce a running cost of the apparatus. Further, downtime of the image forming apparatus due to replacement of the heating means can be reduced as much as possible.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be exemplarily described more specifically. In the following description, it should be understood that dimensions, materials, shapes, relative arrangement, and the like of constitutional parts in the present invention are not intended to be limited to those described specifically unless otherwise specified. Further, unless otherwise specified again, the materials, the shapes, and the like of members once described are the same as those in the previous description.

(Schematic Constitution of Image Forming Apparatus)

First, a schematic constitution of a copying machine of an electrophotographic-type as an example of an image forming apparatus to which the present invention is suitably applicable will be described.

Figure 3:
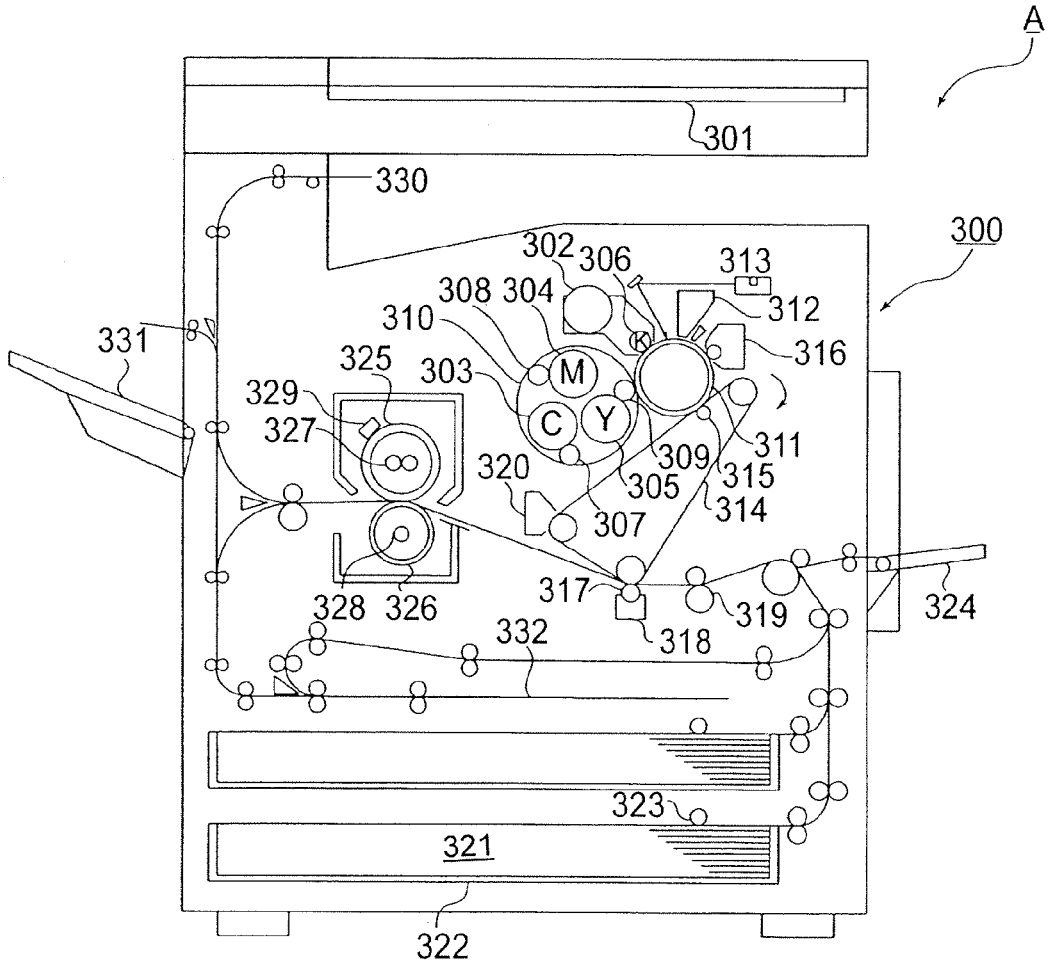
FIG. 3 is a schematic sectional view of the image forming apparatus.

FIG. 3 is a schematic sectional view of the image forming apparatus according to this embodiment.

A copying machine (hereinafter referred to as an "image forming apparatus") A includes an original reader 301. The original reader 301 includes an image pickup device such as a CCD or the like and a color separation filter. By causing the image pickup device to perform reciprocating scanning by means of an unshown motor, an image at an entire surface of an original placed on the original reader 301 is converted into a color-separated electrical signal. The image convened into the electrical signal is, after being subjected to necessary image processing by a CPU 201 (FIG. 2), sent to a printer 300.

In toner units 302 to 305, toners of different colors of Bk (black), C (cyan), M (magenta, and Y (yellow), respectively. The respective toner units 302 to 305 are constituted so that they supply the toners to corresponding developing devices 306 to 309 by screws (not shown).

To a rotary member 310, the toner units 303 to 305 for C, M and Y excluding the toner unit 302 for Bk and the developing devices 307 to 309 are mounted. The developing device 306 for Bk is located at a position other than the position of the rotary member 310.

A photosensitive member 311 is subjected to formation of a toner image on its surface by the developing devices 307 to 309. The rotary member 310 moves to a position opposite to the photosensitive member 311 in the order of the developing devices 307, 308 and 309 by rotation thereof. For this reason, the respective color toner units 303 to 305 cannot form images simultaneously on the photosensitive member 311. Accordingly, the copying machine A forms a toner image for one or more sheet of paper, OHP film, and the like as a recording material on an intermediary transfer member 314 and then transfers the toner image on the sheet.

A charging device 312 electrically charges the surface of the photosensitive member 311. An exposure control portion 313 converts the electrical signal into a light signal and further performs modulation in accordance with an image signal, followed by irradiation of the photosensitive member 311 with the modulated light signal. By this irradiation, an electrostatic latent image is formed on the photosensitive member 311 and a toner image corresponding to the electrostatic latent image is formed by development with the developing devices 306 to 309.

Onto the intermediary transfer member 314, the toner image on the photosensitive member 311 is primary-transferred before the toner image formed on the photosensitive member 311 by development is transferred onto the sheet.

A primary transfer roller 315 is disposed opposite to the photosensitive member 311 through the intermediary transfer member 314 and is used for stably transferring the toner image onto the intermediary transfer member 314. In this case, a residual toner remaining on the photosensitive member 311 without being transferred from the photosensitive member 311 to the intermediary transfer member 314 is removed by a cleaner 316.

The toner image on the intermediary transfer member 314 is conveyed to a position opposite to a secondary transfer roller 317 by the rotation of the intermediary transfer member 314 and is transferred onto the sheet.

The secondary transfer roller 317 is driven by a secondary transfer roller attaching/detaching motor 318 and is used so as to cause the sheet to contact and be separated from the intermediary transfer member 314. Further, prior to the secondary transfer roller 317, a registration roller 319 is provided in order to convey the sheet to the secondary transfer roller 317 at appropriate timing.

The registration roller 319 is provided in order that the sheet conveyed to a position immediately before the registration roller 319 is temporarily stopped and the conveyance of the sheet is started at a timing of image formation to transfer the toner image onto the sheet at an appropriate position. Incidentally, residual toner remaining on the intermediary transfer member 314 without being transferred onto the sheet is recovered by a intermediary transfer member cleaner 320.

A sheet 321 used for image formation by the image forming apparatus A is stored in a sheet cassette 322 and is taken out and fed by a feed roller 323. Further, it is also possible to feed a sheet of an arbitrary size by a manual feed tray 324.

The fed sheet 321 is temporarily stopped by the registration roller 319 until the toner image is completely formed on the intermediary transfer member 314. Thereafter, when the formation of the toner image on the intermediary transfer member 314 is completed, the sheet 321 is conveyed toward the secondary transfer roller 317 by the registration roller 319.

At this time, the secondary transfer roller 317 is placed, in such a state that it rotates while contacting the intermediary transfer member 314, by the secondary transfer roller attaching/detaching motor 318, so that the toner image is transferred from the intermediary transfer member 314 onto the sheet 321 conveyed onto the secondary transfer roller 317.

The sheet 321 on which the toner image is transferred and formed at its surface is conveyed between a fixation roller 325 and a pressure roller 326 as a fixing member and is heat-fixed by the fixation roller 325 and the pressure roller 326. Then, a fixed image of the toner image is formed on the sheet 321. The fixation roller 325 is heated by a fixation roller heater 327 and a pressure roller heater 328.

Figure 1:
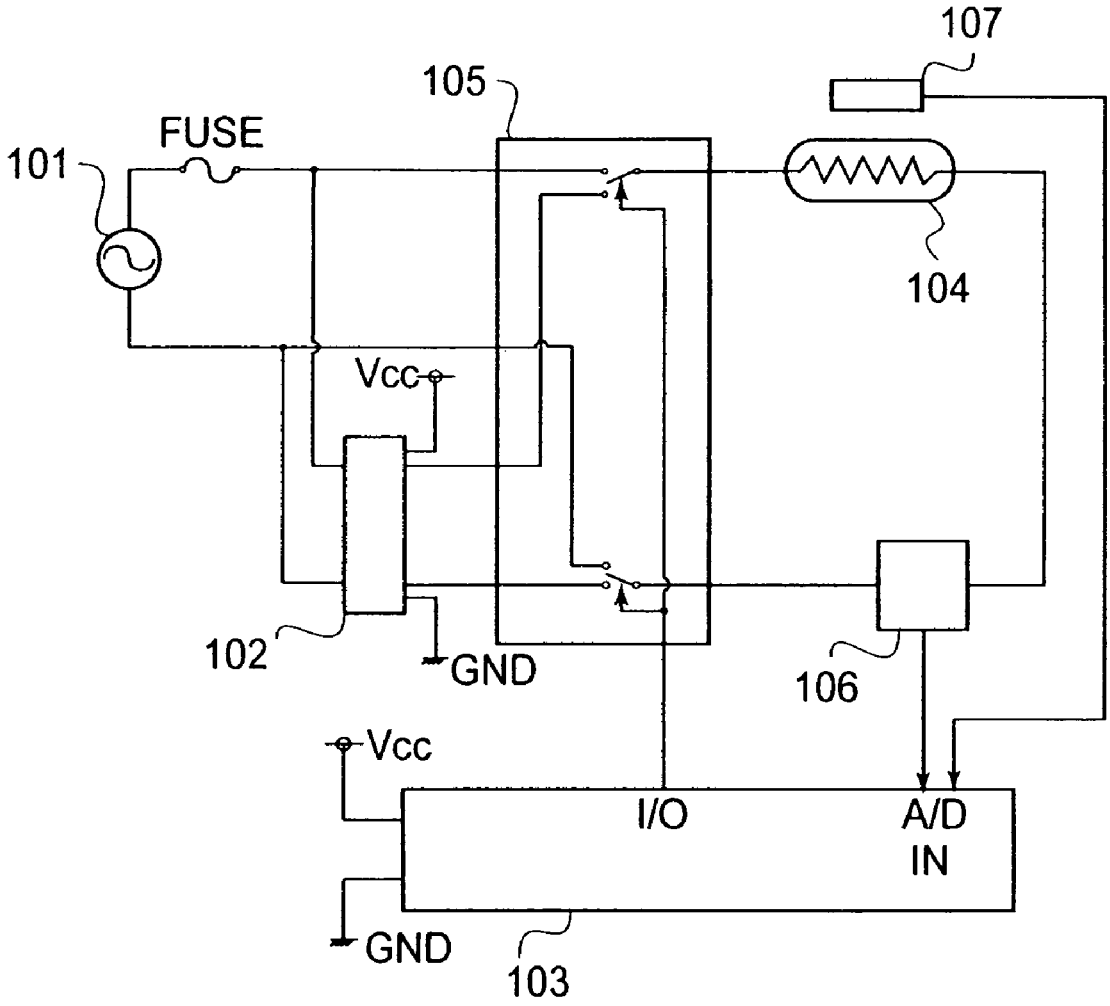
FIG. 1 is a schematic diagram showing a circuit constitution of a fixing heater of an image forming apparatus according to an embodiment of the present invention.

A fixing heater 104 described later shown in FIG. 1 is hereinbelow inclusively referred to as the fixing heater 104 which embraces the fixation roller heater 327 and the pressure roller heater 328.

The fixation roller 325 is provided with a thermally completed temperature detection device 329 and an output is connected with a printer controller 103 (FIG. 1).

(Circuit Constitution of Fixing Heater)

Next, a circuit constitution of the fixing heater 104 of the image forming apparatus A according to this embodiment will be described. FIG. 1 is a schematic view showing the circuit constitution of the fixing heater 104 of the image forming apparatus A of this embodiment.

Into a commercial power input portion 101, commercial AC power is inputted. A switching power source 102 performs conversion from the commercial AC power inputted into equipment into DC power of a plurality of voltages. The printer controller 103 is provided with a microcontroller for performing control of the entire equipment, ROM and RAM for operating control software, I/O for connecting an equipment control device, and an A/D converter for inputting an analog signal from a sensor.

The fixing heater 104 is used for heating the fixation roller 325 for fixing the toner image on the sheet 321. An energization control apparatus 105 effects energization/deenergization control so as to pass an AC current in accordance with a signal from the printer controller 103 or pass a DC current outputted from the switching power source 102.

As the fixing heater 104 for heating the fixation roller 325 and the pressure roller 326, it is possible to utilize a halogen heater, an IH heater, a carbon heater, or the like.

It is preferable that a carbon heater (carbon lamp heater) using a carbon-based material as a heating element is employed. The carbon heater has a quick rise time for heating, thus reducing a heating time. Further, it does not require rush current at the time of turning power on. For this reason, a protection circuit is not required, so that it is possible to reduce cost of the apparatus.

Hereinbelow, a case of using the carbon heater, which is the carbon-based heating element heater, as the fixing heater 104 will be described.

A heater current measuring apparatus 106 as heater current measuring means has a function of measuring a current passing through the fixing heater 104 to output a result of measurement as an analog voltage signal.

A temperature detection device 107 outputs heat generated by the fixing heater 104 as a voltage signal.

Figure 2:
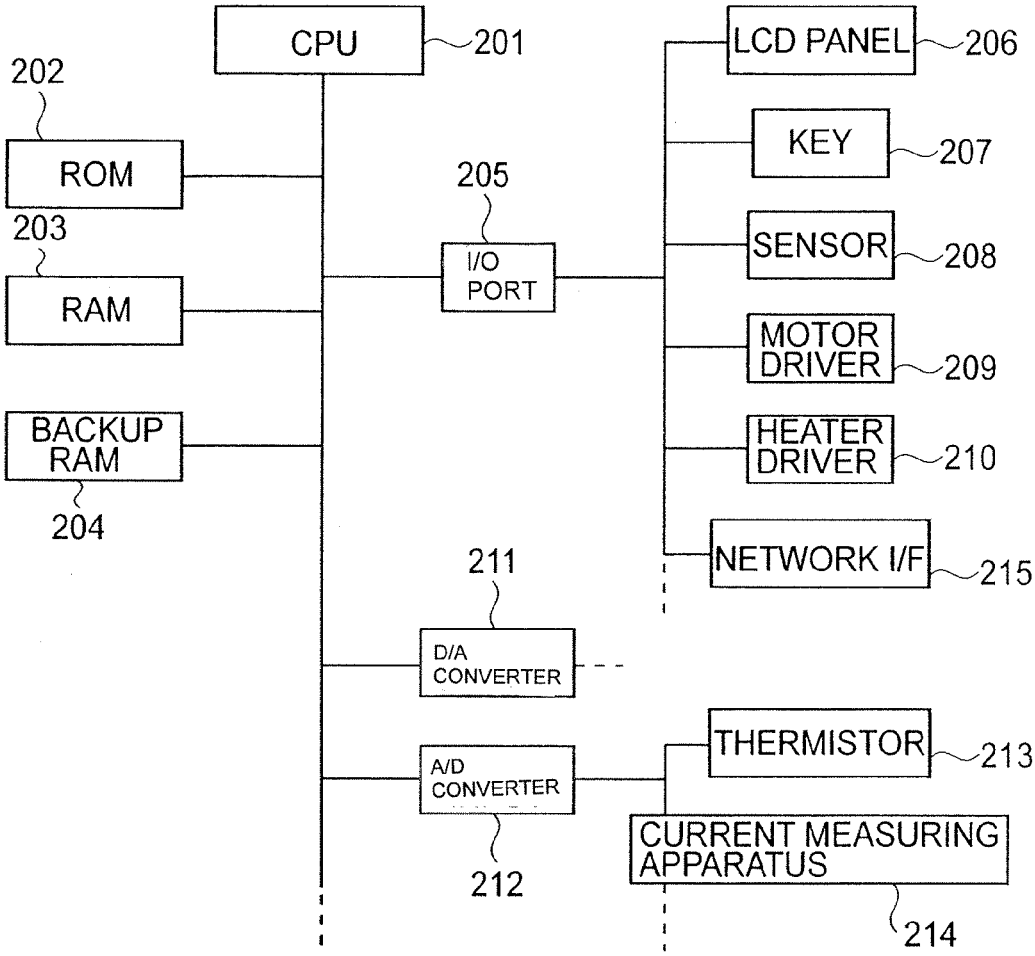
FIG. 2 is a block diagram showing a constitution in a printer controller of the image forming apparatus.

FIG. 2 is a block diagram showing a constitution in the printer controller 103 of the image forming apparatus A of this embodiment.

A CPU 201 performing main control functions as arithmetic means and performs an operation in accordance with software stored in ROM 202 constituted by nonvolatile memory. The CPU 201 effects reading/writing of information with respect to RAM 203 and backup RAM 204, as desired.

The backup RAM 204 is capable of storing information measured and set for performing control and operation of the image forming apparatus A even when the power of the image forming apparatus A is shut off and is supplied with power from an unshown backup battery.

An input/output port 205 of the CPU 201 connects the CPU 201 therethrough with equipment to be connected. An LCD panel 206 on an operation portion displays respective copying modes and setting procedures. The LCD panel 206 may include an LCD portion of a touch screen-type LCD panel.

A key 207 is used for performing the operation of the image forming apparatus A. A second 208 is constituted by a photodiode, a tactile switch, and the like so as to monitor respective states in the image forming apparatus A.

A motor driver 209 drives a stepping motor and a DC motor in the image forming apparatus A. A heater driver 210 is incorporated in the energization control apparatus 105 and performs energization control of AC current or DC current with respect to the fixing heater 104.

A D/A converter 211 outputs an analog voltage signal to an analog voltage signal control apparatus disposed in the image forming apparatus A.

The D/A converter 211 converts the analog voltage signal, which is outputted from the analog voltage signal control apparatus disposed in the image forming apparatus A and is inputted therein, into a digital value to provide means to which the CPU 201 makes reference. Incidentally, in this embodiment, a value of current measured by the heater current measuring apparatus 214 is inputted into an A/D converter 212 as an analog voltage signal having a correlation with the measured current from thermistor 213 and is converted into the digital value.

A network I/F 215 is a network interface for connecting a network for performing communication with other equipment by using a predetermined protocol and receives print instructions and print data from the other equipment through the network and sends internal state data of the image forming apparatus A of this embodiment in accordance with a demand from the other equipment.

Figure 4:
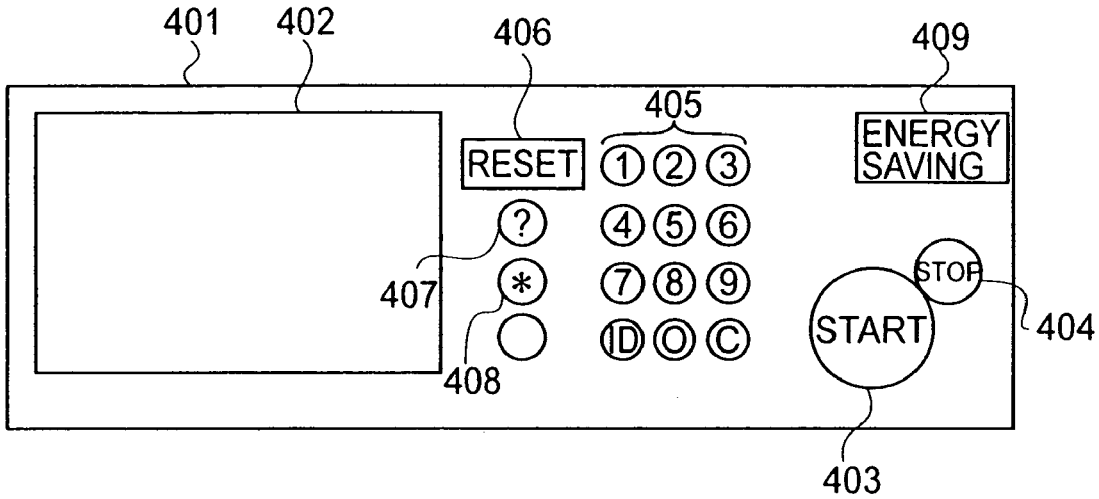
FIG. 4 is a schematic view showing an operation portion of the image forming apparatus.

FIG. 4 is a schematic view showing an example of an operation portion 401 of the image forming apparatus A of this embodiment.

On the operation portion 401, a touch screen-type LCD panel 402 as notification means is provided. The LCD panel 402 has a function of displaying an operation state of the image forming apparatus A, an action entry by a user, settings of the image forming apparatus A, and so on and a function of operation input by the user.

A start button is a button 403 for starting an operation of the image forming apparatus A on the basis of the action entry by the user. A stop button 404 is a button for stopping the image forming apparatus in operation.

A numeric keypad 405 includes buttons for designating the number of copying sheets and inputting various numerical setting values. A reset button is a button 406 for returning a copying setting to an initial value. A guide button 407 is a button for displaying an explanation in a current state on the LCD panel 402.

A user mode button 408 is a button for switching the copying mode into a user mode in which setting suitable for the user is performed. A standby mode button 409 is a button for switching the copying mode into a mode for suppressing power consumption or returning the copying mode to an ordinary mode in the case where the image forming apparatus A is not used for a while.

In the image forming apparatus A of this embodiment, in order to fix the image on the sheet 321, it is necessary to melt and fix toner powder by increasing a temperature of the fixation roller 325 and the pressure roller 326 to about 200° C. For this reason, the printer controller 103 turns the fixing heater 104 on by controlling the energization control apparatus 105 to heat the fixation roller 325 and the pressure roller 326.

However, the fixing heater 104 has a life (span). Further, when the fixing heater 104 reaches the end of life thereof, it cannot be heated up to a predetermined temperature or takes a long time required for temperature rise in some cases even when the temperature rise is possible. For this reason, the 10 fixing heater 104 cannot sufficiently fix the toner image formed on the sheet 321, so that image formation desired by the user cannot be effected in some cases.

In order to avoid such phenomena, in a conventional copying machine, a display indicating that the heater reaches its end of life or an error display has been effected in the case where an energization time of the heater or the number of copying sheets for the fixing device exceeds a predetermined value or the case where the temperature is not increased to a 20 certain temperature in a predetermined time. As a result, there has arisen such problems that detection of the end of life is not accurate and that the heater suddenly reaches its end of life.

On the other hand, the image forming apparatus A of this embodiment has solved the above described problems in the following manner.

A current passing through the fixing heater 104 is converted into a voltage signal by the heater current measuring apparatus 106 and is monitored by the printer controller 103. In this embodiment, such a characteristic that when the fixing heater 104 approaches its end of life, a resistance value thereof is increased is utilized. More specifically, a value of current passing through the fixing heater 104 is measured to calculate a resistance value having a correlation with the measured current value, thus performing detection and estimation of the end of life of the fixing heater 104.

It has been generally known that a heating member used as a heater reacts with oxygen in the air in a high-temperature state to cause gradually a chemical change. For this reason, in order to prevent the chemical change, the heating member is contained in a glass tube in which inert gas is filled and sealed in many cases. However, even in the case of sealing the heating member in the glass tube, a slight amount of oxygen in the air flows into the glass tube, so that it reacts with the heating member in the high-temperature state. As a result, a resistance value of the internal heating member is gradually increased, so that it has been known that the heating member reaches its end of life.

Figure 5:
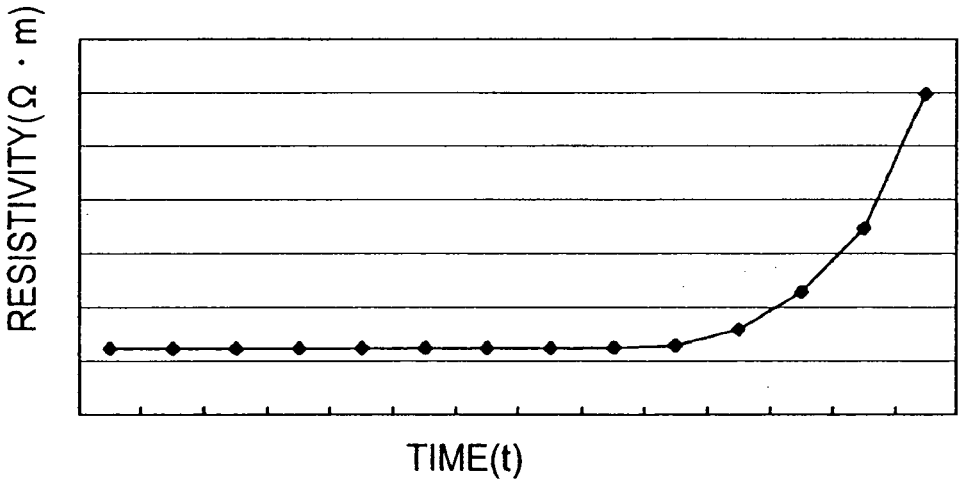
FIG. 5 is a graph showing a change with time in a resistance value of an ordinary heating member.

FIG. 5 is a graph showing a change with time of a resistivity of an ordinary material for the heating member.

In the case of the carbon heater used in this embodiment, it has such a feature that there is no trouble with respect to the life of heater even when it is driven by a low-voltage DC current. In this embodiment, by utilizing this feature, the printer controller 103 controls the energization control apparatus 105 so that a DC current outputted from the switching power source 102 is supplied to the fixing heater 104. When the DC current is applied to the fixing heater 104, a current value measured by the heater current measuring apparatus 106 becomes more accurate.

Incidentally, in the case of a fixing apparatus using the halogen heater used in many electrophotographic copying apparatus, it is difficult to drive it by a current other than an AC current of rated voltage of the heater. For this reason, an energization current is measured in such a state that 20 only the AC current is applied similarly as at the time of ordinary drive. In this case, only the AC current is applied, so that compared with a state wherein a DC current is applied, measurement itself can be performed similarly although a measurement accuracy is lowered.

A measurement result of the current passing through the fixing heater 104 by the heater current measuring apparatus 106 is inputted into the printer controller 103 as an analog voltage signal value. This analog voltage signal value is converted into a digital value by the A/D converter 212 disposed in the printer controller 103 and is referred to by the CPU 201.

The CPU 201 performs the detection of end of life of the fixing heater 104 in accordance with the result of the A/D conversion.

Figure 6:
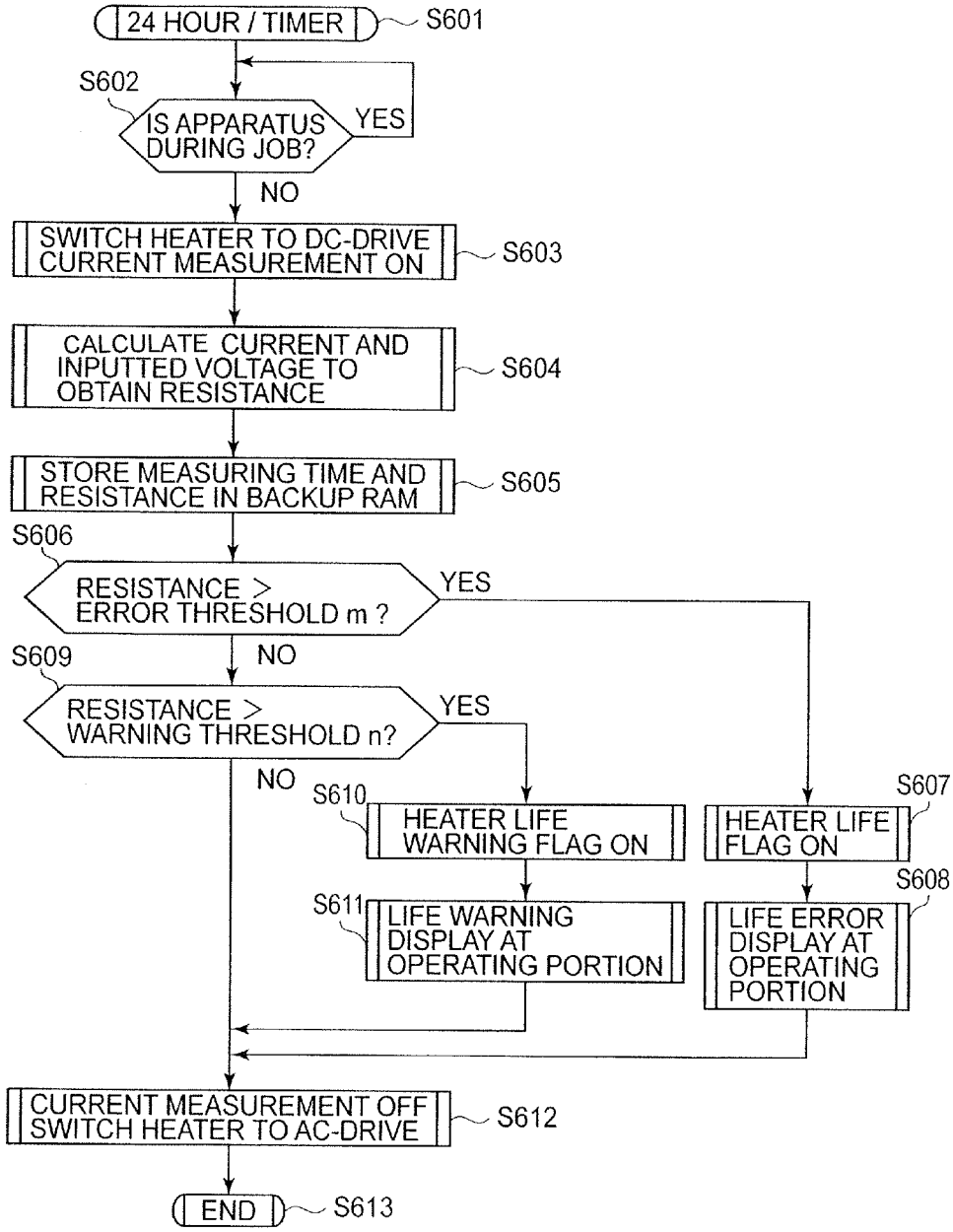
FIG. 6 is a flow chart of an example of a sequence for detecting an end of life of the fixing heater of the image forming apparatus.

FIG. 6 is a flow chart showing an example of a life detection sequence of the fixing heater 104. The life detection sequence shown in FIG. 6 is performed at a certain interval by a timer function of the CPU 201.

In this embodiment, in step S601, when the timer function judges that 24 hours has elapsed from a previous sequence, the life detection sequence is started.

In Step S602, in the case where the image forming apparatus A is judged to be during a job (YES), the sequence is temporarily stopped until the job of the image forming apparatus A is completed. On the other hand, in the case where the image forming apparatus A is not during the job (NO), the printer controller 103 controls the energization control apparatus 105 so as to supply the DC current, outputted from the switching power source 102, to the fixing heater 104. Then, the heater current measuring apparatus 106 is turned on to measure a value of current passing through the fixing heater 104 (Step S603).

In Step S604, the CPU 201 performs arithmetic computation of a voltage signal value (digital value), inputted from the A/D converter 212, corresponding to the current passing through the fixing heater 104 and an inputted voltage value of the fixing heater 104 to calculate a resistance value of the fixing heater 104 having a correlation with the measured current. The resistance value is stored in the RAM 203.

In Step S605, a measuring time and a resistance value are stored in the backup RAM 204. Incidentally, resistance value information of the fixing heater 104 may also be stored in an RAM area which is ensured so that it is capable of storing not only one but also a plurality of pieces of the resistance value information as digital value(s). Further, the resistance value information may also be stored at different addresses each for a predetermined time.

In Step S606, the CPU 201 judges that the fixing heater 104 reaches its end of life when the resistance value exceeds a first threshold value (error threshold value m) (YES) to set a fixing heater life flag (ON) (Step S607). When the fixing heater life flag is set (ON), the CPU 201 causes the LCD panel 402 as notification means to display, as information on the end of life of the fixing heater 104, a message to the effect that the fixing heater 104 has reached its end of life (Step S608), thus notifying a user that it is necessary to replace the fixing heater 104.

Incidentally, the LCD panel 402 as the notification means may display a remaining-time, until the end of life of the heater, calculated by arithmetic computation described later. Further, the notification means usable in this embodiment is not limited to display means such as the LCD panel 402 may be means such that it notifies the user of the end of life of the fixing heater 104 through sound, light, etc.

Figures 7, 8:
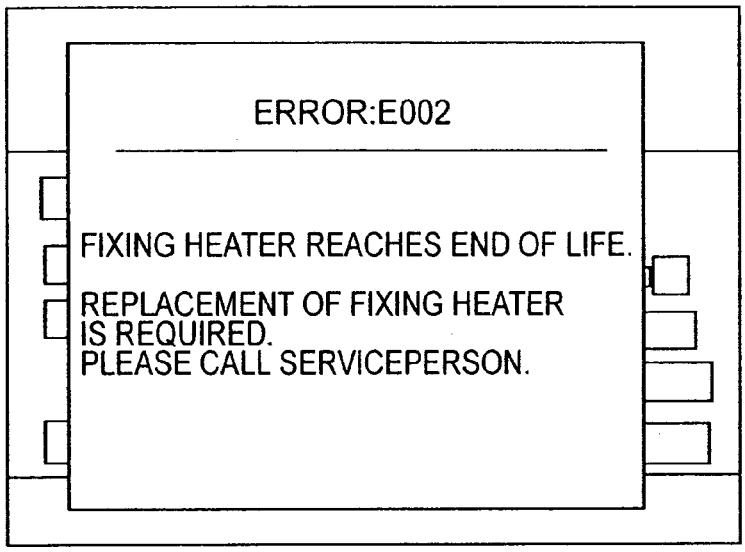
FIG. 7 is a schematic view showing an example of a picture area displayed on an operation panel in the case where the fixing heater has reached its end of life in the image forming apparatus.
FIG. 8 is a table showing an example of a backup RAM table including resistance values calculated from applied voltages and measured current values as a result of measurement of current by energization of the fixing heater in the image forming apparatus.

FIG. 7 is a schematic view showing an example of on-screen information displayed on the operation panel when such a detection that the fixing heater 104 has reached its end of life is performed.

In this embodiment, there arises inconvenience to the user if the operation of the image forming apparatus is stopped by suddenly displaying an error message, so that as a threshold value to be compared with the resistance value, other than the error threshold value m, a warning threshold value n for judging that the remaining-time until the end of the life of the fixing heater 104 is set as a second threshold value. In other words, a plurality of threshold values to be compared with the resistance value are set.

Accordingly, in Step S606, in the case where the calculated resistance value is judged that it does not reach the error threshold value which is a higher threshold value (NO), the resistance value is compared with the warning threshold value n which is a lower threshold value in Step S609.

In Step S609, in the case where the resistance value is judged that it is larger than the warning threshold value n (YES), the fixing heater 104 is judged that it approaches its end of life and a fixing heater life warning flag is set (ON) (Step S610). When the fixing heater life warning flag is set, the CPU 201 causes the LCD panel 402 as the notification means on the operation portion 401 to display a message to the effect that the fixing heater 104 approaches its end of life (Step S611), thus urging the user to replace the fixing heater 104.

Thereafter, the measurement of current passing through the fixing heater 104 is stopped (OFF) (Step S612) to complete the life detection sequence (Step S613).

As described above, by setting the plurality of threshold values, it is possible to notify the user of such a state that the fixing heater 104 approaches its end of life once or a plurality of times before the fixing heater 104 reaches its end of life. Accordingly, the user can have lead time to perform replacement of the fixing heater 104. As a result, it is possible to avoid such a situation that the fixing heater 104 suddenly reaches its end of life and thus a main assembly of the image forming apparatus A cannot be used until completion of the replacement of the fixing heater 104 with another one.

Further, in the above described manner In this embodiment, the resistance value of the fixing heater 104 is used as a reference value, so that it becomes possible to perform detection of end of life with accuracy with respect to not only a fixing heater 104 which has been mounted in the image forming apparatus A from an initial stage but also a fixing heater 104 having an uncertain operation 15 time due to replacement or reuse thereof.

Further, it is also possible to detect a fluctuation in resistance value of the fixing heater 104 by comparing a measured value at the time of previous fixing heater current measurement with a measured value after a lapse of a certain time from the previous measurement.

FIG. 8 is a table showing an example of backup RAM table including data of a resistance values which are calculated from applied voltage values and 25 measured current values by performing measurement of energization current of the fixing heater.

Table 1 shown below is an example of a ROM table showing resistance values at an initial stage and as respective threshold values obtained from characteristics of respective members used In the fixing heater 104.

TABLE 1

| | Resistance value |
|---|---|
| Initial (at shipping) | 12.50000 |
| First warning threshold (remaining life display) | 13.00000 |
| Second warning threshold (remaining life display) | 13.50000 |
| Error threshold (operation stop) | 15.00000 |

The data shown in FIG. 8 and Table 1 are merely sample data and the characteristics are changed depending on constitution of materials used for the fixing heater 104, so that values set in the tables are also changed depending thereon.

For example, the case where the resistance value is measured every 24 hours to provide a measured result as shown in FIG. 8 will be explained. In periods 801 and 802 shown in FIG. 8, a change in resistance value of the fixing heater 104 is slight but in a period 803, the resistance value of the fixing heater 104 is changed markedly. A difference value between there measured resistance values is compared with the values of the respective threshold values for life detection shown in Table 1. As a result, when the resistance value exceeds a certain value, it is possible to judge that the fixing heater 104 approaches its end of life.

Further, it is possible to calculate a remaining-time of the life of the fixing heater 104 by performing comparison and arithmetic computation of resistance value of the fixing heater 104 obtained from current energization current, a differential value of the fixing heater resistance value, and an initial resistance value determined as a characteristic of the fixing heater 104 in advance at the time of designing thereof.

In this embodiment, as shown in FIG. 8, at the end of the period 803, the resistance value of the fixing heater 104 exceeds the first threshold value shown in Table 1. In the period 803, when the previous measured value (digital value) is taken as R26 and the current measured value (digital value) is taken as R27, an incremental value Rdiff in 24 hours of the period 803 is represented by Rdiff R27−R26. By dividing the incremental value Rdiff into a differential value Rremain between an error threshold value Rerror shown in Table 1 and R27, i.e., Rremain=Rerror−R27, it is possible to calculate a remaining-time of the life of the fixing heater 104.

Figure 9:
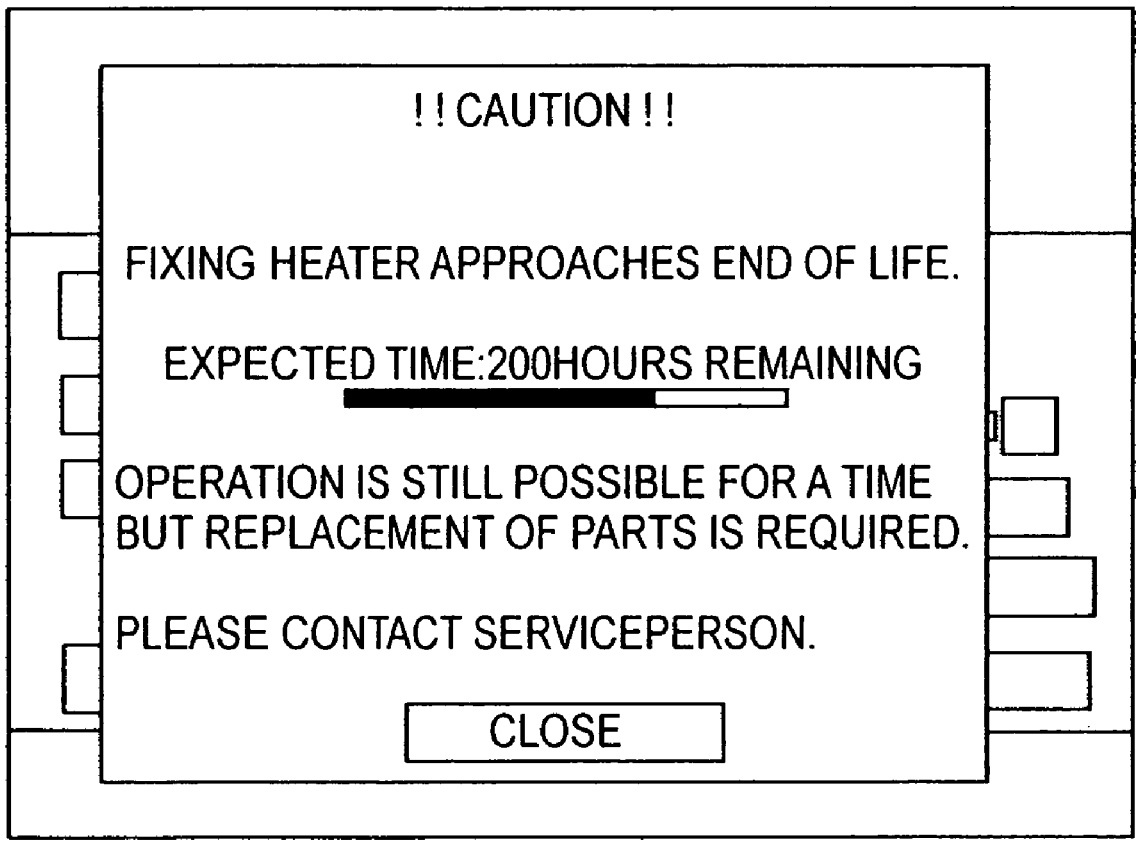
FIG. 9 is a schematic view showing an example of a picture area displayed on the operation panel when the fixing heater approaches its end of life in the image forming apparatus.

In the case where the resistance value of the fixing heater 104 exceeds the warning threshold value n, it is preferable that an on-screen message as shown in FIG. 9 is displayed by using a remaining-time calculated by the above described arithmetic computation. By the above described control and arithmetic computation, it becomes possible to urge the user to replace the fixing heater 104 before it reaches the end of life, so that it is possible to prevent that the fixing heater 104 suddenly reaches its end of life and thus the image forming apparatus A cannot be used. As a result, it is possible to reduce down time of the image forming apparatus A and improve productivity.

In the image forming apparatus A of this embodiment, the above described life detection sequence is performed every 24 hours at 22:00 every day. This is because a life judgement threshold value of the fixing heater 104 is generally determined with a certain margin, so that it is ordinarily sufficient to perform the detection at a long time interval, such as those from on a daily basis to on a weekly basis.

However, execution of the life detection sequence hinders the operation during the job, so that it may desirably be performed during no job execution. Incidentally, it is also possible to provide a user setting screen so as to change an execution time interval of the life detection sequence or measurement timing. It is also possible to perform the life detection during an initial adjusting operation at the time of turning power on of the image forming apparatus main assembly. Further, as a modified embodiment of this embodiment, it is also possible to perform the life detection in a time period which is low frequency in use of the user and memorized in advance.

Further, in the case where the calculated resistance value of the fixing heater 104 exceeds the 15 predetermined value (in the case where the remaining-time to the end of life of the fixing heater 104 is shorter than the predetermined time), control different from that in the ordinary operation may also be performed depending on the remaining-time. More 20 specifically, control may also be performed so that timing for measuring the current passing through the fixing heater 104 is changed so as to narrow the execution time interval of the life detection sequence. According to this control, it is possible to improve a calculation accuracy of the remaining-time until the fixing heater 104 reaches its end of life.

Further, a shift time to power-saving mode is shortened to reduce an unnecessary residual heat waiting time, so that it is also effective to take life-prolonging measures in the case where the fixing heater 104 approaches its end of life.

Incidentally, as the display method of the life judgement result in this embodiment, other than the display method in which the on-screen message as shown in FIG. 9 is displayed on the LCD panel 206 provided to the image forming apparatus A of this embodiment, it is also effective to use a display method utilizing the network I/F 215.

More specifically, in a network to which the image forming apparatus A is connected via the network I/F 215, in the case where a demand for monitoring an operation state of the image forming apparatus A is received from other equipment such as a personal computer connected to the same network, a network-connectable printer system to which various pieces of information such as a print enable/ disable state, toner remaining amount information, paper (sheet) remaining amount information, size information of paper set in a paper feeding cassette, and so on, with respect to the image forming apparatus A are sent has been known. In addition thereto, information of the life detection result by the above described life detection sequence is sent to the printer system, so that information corresponding to the message shown in FIG. 7 or FIG. 9 on a display apparatus such as a display or the like of the above described personal computer may also be displayed.

According to such control, it is possible to confirm the life reaching information or the remaining life information of the fixing heater 104 from the personal computer or the like disposed in a distant place even when the user is not around the image forming apparatus A. As a result, in the case where an administrator or service person of the image forming apparatus A is in a distant place, the person can come to an instruction location of the image forming apparatus A after preparing replacement parts in advance. Accordingly, it is effective to alleviate a down time.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 218390/2004 filed Jul. 27, 2004, which is hereby incorporated by reference.

What is claimed is:

1. An image forming apparatus, comprising:

fixing means for fixing a toner image formed on a recording material, heating means, for heating said fixing means, comprising a carbon-based material, current measuring means for measuring a current passing through said heating means, and notification means for providing notification of information on a life of said heating means depending on an output of said current measuring means.

2. An apparatus according to claim 1, wherein said apparatus further comprises storing means for storing the output of said current measuring means, and wherein said notification means provides information on a remaining life of said heating means depending on progression of data stored in said storing means.

3. An apparatus according to claim 1, wherein said apparatus further comprises storing means for storing the output of said current measuring means, and wherein a frequency of execution of life judgement of said heating means is changed depending on transition of data stored in said storing means.

4. An apparatus according to anyone of claims 1-3, wherein said notification means comprises display means for displaying information on the life of said heating means.

* * * * *

UNITED STATES PATENT AND TRADEMARK OFFICE

CERTIFICATE OF CORRECTION

PATENT NO. : 7,292,795 B2
APPLICATION NO. : 11/186960
DATED : November 6, 2007
INVENTOR(S) : Kuroki et al.

It is certified that error appears in the above-identified patent and that said Letters Patent is hereby corrected as shown below:

COLUMN 4:
Line 13, “a” should read --an--.

COLUMN 7:
Line 31, “20” should be deleted.

COLUMN 9:
Line 5, “In” should read --in--.
Line 19, “a resistance values” should read --resistance values--.
Line 20, “25” should be deleted.
Line 26, “In” should read --in--.

COLUMN 10:
Line 39, “15” should be deleted.
Line 43, “20” should be deleted.

COLUMN 12:
Line 24, “anyone” should read --any one--.

Signed and Sealed this

Eighth Day of July, 2008

JON W. DUDAS
*Director of the United States Patent and Trademark Office*